US009127655B2

(12) United States Patent
Wang et al.

(10) Patent No.: US 9,127,655 B2
(45) Date of Patent: Sep. 8, 2015

(54) LIQUID NITROGEN PUMP EQUIPMENT LOAD TESTING AND EXPERIMENTING APPARATUS AND TESTING AND EXPERIMENTING METHOD THEREOF

(75) Inventors: Shulong Wang, Tianjin (CN); Xianying Tan, Tianjin (CN); Xiaolin Wang, Tianjin (CN); Hongguang Zhang, Tianjin (CN); Yongqing Shi, Tianjin (CN); Fang Gu, Tianjin (CN)

(73) Assignees: China National Petroleum Corporation (CN); CNPC Bohai Equipment Manufacturing Co., Ltd. (CN)

( * ) Notice: Subject to any disclaimer, the term of this patent is extended or adjusted under 35 U.S.C. 154(b) by 333 days.

(21) Appl. No.: 13/879,111

(22) PCT Filed: Sep. 28, 2011

(86) PCT No.: PCT/CN2011/001642

§ 371 (c)(1),
(2), (4) Date: Apr. 12, 2013

(87) PCT Pub. No.: WO2012/048524

PCT Pub. Date: Apr. 19, 2012

(65) Prior Publication Data

US 2013/0195690 A1 Aug. 1, 2013

(30) Foreign Application Priority Data

Oct. 14, 2010 (CN) ..... 2010 1 0509340

(51) Int. Cl.
*E03B 5/00* (2006.01)
*F04B 7/02* (2006.01)

(Continued)

(52) U.S. Cl.
CPC . *F04B 7/02* (2013.01); *F04B 15/08* (2013.01); *F04B 51/00* (2013.01); *F04B 2015/0824* (2013.01)

(58) Field of Classification Search
CPC ..... F04B 51/00; F04B 2015/0824; E21B 43/006; E21B 43/26; E21B 43/166; C09K 8/703; C09K 8/594; C09K 8/94; C09K 8/38
USPC ..... 137/487.5, 565.01, 565.13, 565.14, 137/565.16, 565.19, 565.33
See application file for complete search history.

(56) References Cited

U.S. PATENT DOCUMENTS 3,396,107 A * 8/1968 Hill ..... 507/202
4,569,394 A * 2/1986 Sweatman et al. ..... 166/280.1

(Continued)

FOREIGN PATENT DOCUMENTS

CN 101178062 A 5/2008
CN 101696684 A 4/2010

(Continued)

OTHER PUBLICATIONS

"International Application No. PCT/CN2011/001642, International Search Report mailed Jan. 5, 2012", (Jan. 5, 2012), 8 pgs.

*Primary Examiner* — Matthew W Jellett
(74) *Attorney, Agent, or Firm* — Schwegman Lundberg & Woessner, P.A.

(57) ABSTRACT

The disclosure relates to liquid nitrogen pump equipment load testing and experimenting apparatus, and testing and experimenting method thereof, used for oil-gas fields or coal-bed methane nitrogen foam fracturing equipment testing. A hydraulic damping apparatus unit and a pressure regulation unit are provided; the hydro-mechanical damping apparatus unit comprises a water tank, a pump unit apparatus, and a pipe manifold system connected in sequence.

8 Claims, 2 Drawing Sheets

(51) Int. Cl.
*F04B 15/08* (2006.01)
*F04B 51/00* (2006.01)

(56) References Cited

U.S. PATENT DOCUMENTS 5,000,262 A * 3/1991 Danzik ..... 166/272.3
5,069,283 A * 12/1991 Mack ..... 166/308.6
5,103,910 A * 4/1992 Chan ..... 166/294
8,991,499 B2 * 3/2015 Nevison ..... 166/308.2
2009/0183874 A1 * 7/2009 Fordyce et al. ..... 166/280.1
2010/0107748 A1 5/2010 Feldges et al.
2014/0174747 A1 * 6/2014 Kelly et al. ..... 166/308.2

FOREIGN PATENT DOCUMENTS

CN 101968051 A 2/2011
CN 201874796 U 6/2011
SU 569748 A1 8/1977
SU 979699 A1 12/1982

* cited by examiner

LIQUID NITROGEN PUMP EQUIPMENT LOAD TESTING AND EXPERIMENTING APPARATUS AND TESTING AND EXPERIMENTING METHOD THEREOF

PRIORITY CLAIM TO RELATED APPLICATIONS

This application is a national stage application under 35 U.S.C. §371 of PCT/CN2011/001642, filed Sep. 28, 2011, and published as WO 2012/048524 A1 on Apr. 19, 2012, which claims priority to Chinese Application No. 201010509340.9, filed Oct. 14, 2010, which applications and publication are incorporated by reference as if reproduced herein and made a part hereof in their entirety, and the benefit of priority of each of which is claimed herein.

FIELD OF THE INVENTION

The present invention relates to the technical field of nitrogen foam fracturing pump equipments for oil-gas fields or coal bed methane, especially to an apparatus for loading test and experiment of liquid nitrogen pump equipments and the test and experiment process thereof, which can load the gas discharged from a liquid nitrogen pump in a nitrogen foam fracturing equipment, and the invention also relates to an apparatus for overall experiment of liquid nitrogen pump equipments, which is not only used for testing the flow rate of liquid nitrogen pump equipments, but also for loading, testing and experimenting on the pressure of the discharged nitrogen gas.

BACKGROUND OF THE INVENTION

Nitrogen foam fracturing is a novel technology developed on the basis of the hydraulic fracturing technology and is in particular suitable for improving the low-pressure, low-permeable and water-sensitive formulation during the oil-gas field exploitation and the coal bed methane exploitation. Such technology is also widely applied in the technical field of nitrogen flooding exploitation for coal gas methane. In the existing nitrogen foam fracturing technology, the overall testing technology for the nitrogen foam fracturing equipment is not yet mature and the experiment apparatus is not yet consummate. In particular, the liquid nitrogen pump, as an important equipment among others, requires a set of integrated apparatus for the overall test and experiment of liquid nitrogen pump equipments.

The liquid nitrogen pump equipment is a specialized equipment that discharges liquid nitrogen through a liquid nitrogen pump under pressure and then heats the high pressure liquid nitrogen by a specialized heating apparatus so as to convert it into gaseous nitrogen at normal temperature. The typical characteristic of the liquid nitrogen pump equipment lies in the fact that the input medium is low temperature liquid medium but the output is high pressure gas with large displacement. The liquid pump equipment is an important equipment applied in the oil-gas field and coal gas methane foam fracturing, and thus requires periodical checkout so as to ensure the security of the field operation. At present, mainly utilized is the loading experiment apparatus for liquid nitrogen pump equipments in the overall test and experiment of the liquid nitrogen pump equipment. The loading experiment apparatus for liquid nitrogen pump equipments mainly works in testing and experimenting on both the displacement and pressure of the discharged gas of the liquid nitrogen pump equipment so as to check out the performance of the liquid nitrogen pump equipment.

The output gas displacement of the liquid nitrogen equipment in practical application depends on the power transmitting system and the flow distributing system of the equipment, whereas the pressure of the output gas displacement depends on the factors comprising fracture pressure of the formation, formation permeability, and pipe resistance, etc., during the foam fracturing operation completed thereby. In consideration that the fracture pressure of the formation, the formation permeability, and the pipe resistance are relatively constant during the experiment, it can not be readily realized to adjust the discharge pressure of the gas discharged from the liquid nitrogen pump equipment, and thus such apparatus is not appropriate to be used as experiment technology for the liquid nitrogen pump equipment. Nowadays, the domestic test and experiment apparatus is only able to satisfy the requirement of overall test and experiment of the liquid nitrogen pump equipment with relatively low pressure and low displacement in China. However, the liquid nitrogen pump equipment used for nitrogen foam fracturing has the characteristics as follows: large installed power, which reaches 1500 kW; large displacement, which reaches 600 $Sm^3$/min ($Sm^3$ means normal cubic meter and is specialized as an unit of gas volume. $Sm^3$ refers to volume of gas under standard temperature and pressure, wherein S is the initial of English word "standard"); high discharge pressure, which reaches 140 MPa; the test and experiment of such equipment substantially differ from those of the liquid nitrogen pump equipment with low pressure and low displacement in terms of security risk. Accordingly, the requirements to the overall test and experiment of such equipment will significantly differ from those to normal liquid nitrogen pump equipment with low pressure and low displacement, mainly in terms of the pressure loading technology and also the data collecting and analyzing technologies. As for the liquid nitrogen pump with low displacement, the loading of discharge pressure may be carried out using a loading method by directly regulating valves under complete safe security; the data collecting and analyzing may also be directly obtained during the test and experiment of the liquid nitrogen pump equipment with low pressure and low displacement. However, as for the test and experiment of the liquid nitrogen pump equipment with high pressure and large displacement, a huge pressure regulating valve will be needed so as to realize the adjustment of discharge pressure if using the method of direct pressurizing mentioned above, which is technically very difficult to implement. On the other side, direct adjustment of gas with high pressure and large displacement renders high security risk for adjusting and monitoring, and thus results in high security risk during the test and experiment. Therefore, at present, there is urgent requirement for a test and experiment technology that is appropriate for foam fracturing liquid nitrogen pump equipment with high pressure and large displacement.

SUMMARY OF THE INVENTION

The object of the present invention is to eliminate defects in prior art and to provide an apparatus in indirect and safe manner for loading test and experiment of liquid nitrogen pump equipments and the test and experiment process thereby.

As follows is the technical solution by which the object of the invention can be achieved.

1. An apparatus for loading test and experiment of liquid nitrogen pump equipment, which is intended to test nitrogen foam fracturing equipments for oil-gas fields or coal bed methane, said apparatus comprises, A liquid nitrogen pump equipment testing unit which further comprises liquid nitrogen tank and tested liquid nitrogen pump equipment, wherein the liquid nitrogen pump equipment is arranged on the outlet pipeline of the liquid nitrogen tank and pumps liquid nitrogen stored at low pressure and low temperature in the liquid nitrogen tank and converts it into gaseous nitrogen at normal temperature and high pressure;

A hydraulic damping apparatus unit comprising a water tank, pump set equipment, and a manifold system which are connected in sequence, wherein the manifold system mixes the gaseous nitrogen at normal temperature and high pressure from the liquid nitrogen pump equipment with high pressure water from the pump set equipment to form a high pressure liquid-gas mixture;

A pressure adjusting unit arranged downstream from the hydraulic damping apparatus unit, which pressurizes the water discharged from the hydraulic damping apparatus unit by adjusting the flow rate of the high pressure liquid-gas mixture;

2. The pressure adjusting unit therein comprises at least one adjusting units, which are connected with each other, and subsequent water recycling equipments, wherein each of said adjusting units further comprises the following parts which are connected in sequence, A liquid-gas mixture output manifold assembled downstream from the manifold system, which distributes the mixed high pressure liquid-gas mixture as output;

At least one pneumatic cut-off valve, which roughly adjusts discharge pressure of the hydraulic pump truck;

At least one motor-driven pressure regulating valve, which finely adjusts the discharge pressure of the hydraulic pump truck;

A throttling hush pipe, which applies pressure loading to the high pressure water discharged from the pump set equipment and limits noise by a silencer.

3. The manifold system therein comprises a high pressure water valve, a high pressure gas valve, a check valve and also pipelines.

4. The outlet pipelines of the water tank and the liquid nitrogen tank therein are equipped with check valves and also pressure sensors, respectively.

5. The subsequent water recycling equipments therein are connected to the outlet of the throttling hush pipe and comprises in sequence a gathering apparatus, a liquid-gas separator, connecting pipelines, a cooling system and also a recycling manifold, wherein the recycling manifold is connected to the water tank of the hydraulic damping apparatus unit;

wherein the gathering apparatus collects water and nitrogen gas and transports them into the liquid-gas separator which separates water from nitrogen gas, and the separated nitrogen gas is discharged under security condition, whereas the separated water continues to flow into the water tank through the connecting pipelines, the cooling system and the recycling manifold so as to be recycled.

6. The pump set equipment therein is assembled on the outlet pipeline of the water tank, and said pump set equipment is a hydraulic pump truck or combination of a water pump and a power system.

In addition, the present invention also provides a loading test and experiment process for liquid nitrogen pump equipments, wherein the loading test and experiment of the liquid nitrogen pump equipments, which are used for foam fracturing of the oil-gas field or coal bed methane nitrogen, are carried out by using the loading test and experiment apparatus described above. Using the hydraulic damping apparatus, firstly, gas discharged from the liquid nitrogen pump is mixed with high pressure water discharged from the hydraulic damping apparatus so as to form a high pressure liquid-gas mixture, and then the flow rate of the high pressure liquid-gas mixture is adjusted, so that the pressure adjustment of the gas discharged from the liquid nitrogen pump equipment is indirectly achieved. The above process may further comprises the following steps, Firstly, the hydraulic pump truck is started and the water discharged from the hydraulic pump truck is pressurized, and simultaneously the pneumatic cut-off valve in the pressure adjusting unit is opened for roughly adjusting the water pressure, while the motor-driven pressure regulating valve is also opened for finely adjusting the water pressure, so that accurate adjustment of the discharge pressure of the hydraulic pump truck is achieved;

Secondly, the liquid nitrogen pump equipment is started and the gaseous nitrogen discharged from the liquid nitrogen pump equipment is mixed with the high pressure water discharged from the hydraulic pump truck in the manifold system so as to form a high pressure liquid-gas mixture, and then the flow rate of the high pressure liquid-gas mixture is adjusted by the pneumatic cut-off valve and the motor-driven pressure regulating valve, so that the pressure of the nitrogen gas discharged from the liquid nitrogen pump equipment is controlled.

DETAILED DESCRIPTION OF THE INVENTION

Figure 1:
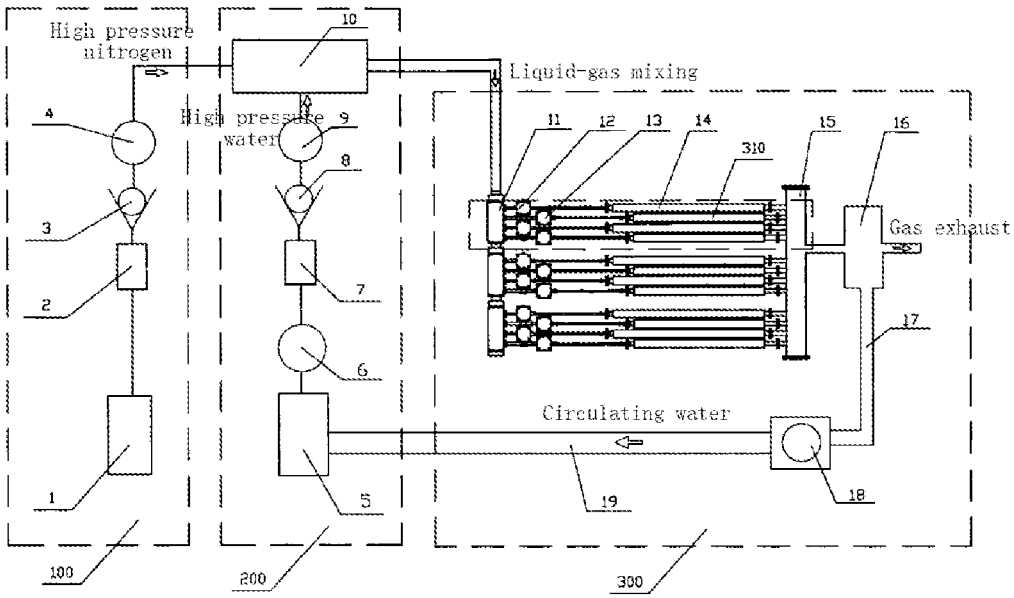
FIG. 1 is a structural schematic drawing of the loading test apparatus for liquid nitrogen pump equipments in accordance with the present invention.

The present invention will be described in detail below with reference to the drawings. However, it should be known for one person skilled in the art that the present invention is not limited by the listed embodiments, and any technical solution that accords with the spirit of the invention will fall within the protection scope of the invention.

The principle of the present invention will be described below.

During the test and experiment of liquid nitrogen pump equipments used for nitrogen foam fracturing, the discharge pressure and displacement of the liquid nitrogen pump equipment should be respectively tested so as to give the relationships between the displacement and the pressure, between the input power and output pressure and between the pressure and the loading time. It can be seen that the discharge pressure of the liquid nitrogen pump equipment is key parameter that should be controlled during the overall test and experiment of liquid nitrogen pump equipments. In order to complete the overall test and experiment of liquid nitrogen pump equipment, it is required to set damping to the gas discharged from such equipment, that is to say, to carry out pressure loading. Because the gas has large compression ratio, it is very difficult to directly and securely load the gas with large displacement. Therefore, the loading experiment apparatus for liquid nitrogen equipment in accordance with the present invention is particularly installed a hydraulic pump truck so that the gas discharged from the liquid nitrogen pump equipment is mixed with water in the hydraulic damping apparatus so as to form a high pressure liquid-gas mixture, and then the pressure adjustment of the gas discharged from the liquid nitrogen pump equipment is indirectly achieved by adjusting the flow rate of the high pressure liquid-gas mixture. Thus, the pressure loading of the gas discharged from the liquid nitrogen pump equipment may be indirectly achieved by converting the liquid pressure loading into gas pressure loading.

In the loading test and experiment apparatus for liquid nitrogen pump equipments in accordance with the present invention, the hydraulic damping apparatus adjusts the output flow rate of the water discharged from the hydraulic pump equipment therein, while the pressure is adjusted by a pressure adjusting unit. The pressure adjusting unit mainly comprises a pneumatic cut-off valve component and a motor-driven pressure regulating valve, wherein the pneumatic cut-off valve component is used for rough adjustment of the discharge pressure, while the component is used for fine adjustment of the output pressure. Meanwhile, nitrogen gas discharged from the liquid nitrogen pump equipment is mixed with liquid discharged from the hydraulic fracturing equipment by using a specialized manifold. Thus, the nitrogen gas displacement of the liquid nitrogen equipment may be controlled by the power transmitting system and also the flow distributing system of the equipment per se.

The present invention will be described in detail by reference with the examples below. FIG. 1 is a structural schematic drawing of the loading test apparatus for liquid nitrogen pump equipments in accordance with the present invention. The loading test apparatus for liquid nitrogen pump equipments in accordance with the present invention mainly comprises three major parts as follows.

1. Liquid nitrogen pump equipment test unit 100, which further comprises the following elements that connects with each other from upstream to downstream of liquid nitrogen, Liquid nitrogen tank 1, which is a normal pressure vessel for storing liquid nitrogen and stores liquid nitrogen that is to be used in the loading test of the liquid nitrogen pump equipment.

Liquid nitrogen pump equipment 2, which is just the liquid nitrogen pump equipment that is to be tested for its performance in the invention, used for oil-gas field or coal bed methane nitrogen foam fracturing and arranged on the outlet pipeline of liquid nitrogen tank 1 so as to pump liquid nitrogen from the liquid nitrogen tank 1; The role of the liquid nitrogen pump equipment 2 is to pump the liquid nitrogen tank at low pressure and low temperature by the high pressure pump so as to form liquid nitrogen at high pressure and low temperature, and then the latter is heated by the specialized liquid nitrogen evaporator equipped on the liquid nitrogen pump equipment 2, so that the liquid nitrogen at high pressure and low temperature is converted into gaseous nitrogen at high pressure and normal temperature. In one embodiment, the gas displacement of the nitrogen foam fracturing pump equipment used for oil-gas field exploitation or coal bed methane exploitation in accordance with the invention is in the range of 90 to 600 $sm^3$/min, which is divided into four grades of 35 MPa, 70 MPa, 105 MPa and 140 MPa according to the discharge pressure grade. It is required for the experiment apparatus to accomplish the full-loading tests on the liquid nitrogen apparatus wherein the nominal output is in the range of 90 to 600 $sm^3$/min and the nominal pressure is one of 35 MPa, 70 MPa, 105 MPa and 140 MPa.

Check valve 3 arranged downstream from the liquid nitrogen pump equipment 2, which is used to prevent nitrogen gas flowing back.

Pressure sensor 4, which collects pressure data of the discharged nitrogen gas and transports it to the control system.

2. Hydraulic damping apparatus unit 200, which further comprises the following elements that connects with each other from upstream to downstream of water, Water tank 5, which is a normal vessel used for storing water.

Flow sensor 6 arranged on the outlet pipeline of the water tank 5, which collects the outlet flow rate of the water tank 5 and transports it to the control system.

Hydraulic pump truck 7, which may be a hydraulic fracturing pump truck in practical experiment, is a high power and high pressure hydraulic pump equipment. Its displacement should satisfy the highest displacement requirement based on the lowest foam quality requirement, and its highest pressure should be equal to or higher than the highest discharge pressure of the liquid nitrogen equipment. For example, in order to accomplish the test on a liquid nitrogen equipment with a normal gas displacement of 330 $sm^3$/min and a normal discharge pressure of 105 MPa, it is required that the mixed foam quality is controlled within 20% and the hydraulic fracturing pump truck has a liquid normal displacement equal to or greater than 1.9 $m^3$/min and a discharge pressure equal to or greater than 105 MPa so as to ensure the security during the test and experiment. Accordingly, it is required to provide a hydraulic fracturing pump truck of 1500 type (i.e. its normal discharge power is 1500 kW) having a normal discharge pressure of 105 MPa, such as a YLC1500-105 fracturing truck (SY/T 5211-2009). Also, the process may be accomplished by using two fracturing trucks having a discharge pressure of 105 MPa and a normal displacement in range of 1.0-1.9 $m^3$/min Selecting the form of pump trucks is because a equipment with the form of pump trucks will be easy to be placed and installed during the field test. Meanwhile, the high power and high pressure hydraulic pumps owned by oilfield enterprises are also commonly in vehicle-mounted form. The hydraulic pump truck may be replaced by pump set equipments provided that the pump set equipments composed of water pumps and power systems not only satisfies the requirement of technical parameters but also is appropriate to be placed and installed in work field.

Check valve 8 arranged downstream from the hydraulic pump truck 7, which is used to prevent water flowing back.

Pressure sensor 9, which collects pressure data of water and transports it to the control system.

Manifold system 10, which is composed of a high pressure water valve, a high pressure gas valve, a check valve that resists high pressure and is appropriate for transporting liquid-gas mixture and also pipelines, allows the high pressure water described above to mix with high pressure and normal temperature nitrogen gas. That is, nitrogen gas at normal temperature and high pressure from the liquid nitrogen pump equipment test unit 100 is mixed with water from hydraulic damping equipment unit 200, during which high pressure nitrogen gas is mixed into the discharged high pressure water so as to form a high pressure liquid-gas mixture. The pressure of such high pressure liquid-gas mixture is the damping that the liquid nitrogen pump needs to overcome for discharging gas.

3. Pressure adjusting unit 300 is arranged downstream from the hydraulic damping apparatus unit 200, and comprises a plurality of adjusting unit 310 and also subsequent water recycling equipments. The pressure adjusting unit 300 pressurizes the water discharged from the hydraulic pump truck 7 by adjusting the flow rate of the high pressure liquid-gas mixture discharged from the hydraulic damping apparatus unit 200.

In the pressure adjusting unit 300, each adjusting unit 310 further comprises the following parts that connect in sequence:

Liquid-gas mixture output manifold 11 arranged downstream from the manifold system 10, the role of which is to distribute the mixed high pressure liquid-gas mixture into each pressure adjusting mechanism.

Pneumatic cut-off valve 12, which roughly adjusts the discharge pressure of the hydraulic pump truck by using a pneumatic motor as the adjusting mechanism for adjusting the pressure.

Motor-driven pressure regulating valve 13, the role of which is to adjust pressure as the mechanism for implementing adjustment by using a servo motor and optionally to carry out feedback control so that the discharge pressure of the hydraulic pump truck is roughly adjusted.

In a practical process, around 90% of the pressure needed to be adjust to can be obtained by using the pneumatic cut-off valve 12, and the remaining 10% of the pressure adjustment can be achieved by using the motor-driven pressure regulating valve 13. For example, when the liquid nitrogen pump equipment to be tested has a normal gas displacement of 330 $sm^3$/min and a normal discharge pressure of 105 MPa, a YLC1500-105 fracturing truck is provided as the fracturing truck and the discharge pressure is required to be adjusted to 105 MPa, then firstly the discharge pressure may be controlled in range of 92 to 96 MPa using the pneumatic cut-off valve 12, and subsequently within 105 MPa using the motor-driven pressure regulating valve 13.

Throttling hush pipe 14, which applies pressure loading to the high pressure water discharged from the hydraulic pump truck by utilizing the throttling principle and limits noise by a silencer. The throttling hush pipe is composed by a diffusion section of the throttler and a hush pipe, and the throttling hush pipe is covered by noise reduction and insulation material. The role of the diffusion section is to gradually decrease the flow rate of the high speed liquid-gas mixture, and much noise will be generated along with the decreasing pressure during this process. The noise generated in the experiment and test process is limited by using the noise reduction and insulation material that covers the throttling hush pipe.

One or more adjusting units 310, which are connected with each other in parallel, can be used in the present invention. In addition, the quantities of the pneumatic cut-off valves 12, the motor-driven pressure regulating valves 13 and also the throttling hush pipes 14 to be used in the test and experiment process may also be determined according to the liquid and gas displacement in each of the adjusting units 310. In order to ensure that the adjusting unit installation is highly dependable per se, it is required to control the highest flow rate of the water after adjustment. In one embodiment, the highest flow rate of the water is limited within 200 m/s in the apparatus in accordance with the present invention. In this case, if to be accomplished is the test on a liquid nitrogen pump equipment with a normal gas displacement of 330 $sm^3$/min, the fracturing truck provided is a YLC1500-105 fracturing truck and the liquid displacement is required to achieve 1.9 $m^3$/min, it will be needed to use two pneumatic cut-off valves 12 and two motor-driven pressure regulating valves 13, while the quantity of the adjusting unit 310 is one.

The outlet of the throttling hush pipe 14 is connected to subsequent water recycling equipments, which comprise in sequence a gathering apparatus 15, a liquid-gas separator 16, connecting pipeline 17, a cooling system 18 and also a recycling manifold 19, wherein the recycling manifold 19 is connected to the water tank 5 of the hydraulic damping apparatus unit 200;

The high pressure liquid-gas mixture flows through a plurality of adjusting units 310 and then through the throttling hush pipe 14 so as to be converted into low pressure liquid-gas mixture, and a great deal of heat will be generated along with this process. The role of the gathering apparatus 15 is to collect water and nitrogen gas and transports them into the liquid-gas separator 16, while the role of the liquid-gas separator 16 is to separate the mixture of water and nitrogen gas formed during the test. The separated nitrogen gas is discharged under security condition, whereas the separated water flows into the water tank 5 through the connecting pipeline 17, the cooling system 18 and the recycling manifold 19 so as to be recycled. In one embodiment of the invention, the cooling system 18 comprises a cooling column, a plate-type heat exchanger, a recycling pump, valves and pipelines. Because energy generated in the test is absorbed by water, which acts as the experiment medium, resulting in temperature rising, the cooling system 18 is used to cool the water recycled in the test and decrease its temperature and plays a role in stabilizing the liquid flow. In other embodiments, other known technology may also be employed for the cooling system 18.

Because the controlling to the nitrogen gas displacement of liquid nitrogen equipments is achieved by using the power transmitting system and the flow distributing system of the liquid nitrogen pump equipment test unit 100 and the hydraulic damping apparatus unit 200 per se, no additional power is needed and thus the equipment cost as well as energy can be saved.

The above description is made in terms of the structure of the loading test and experiment apparatus for liquid nitrogen pump equipment in accordance with the invention. The test and experiment process will be described in detail below.

Firstly, the hydraulic pump truck 7 is started and the water discharged from the hydraulic pump truck 7 is pressurized. The water pressure is measured by the pressure sensor 9. Simultaneously, the pneumatic cut-off valve 12 in the pressure adjusting unit 300 is opened for rough adjustment of the water pressure, and the discharge pressure may be preliminary obtained by regulating the pneumatic cut-off valve 12. The motor-driven pressure regulating valve 13 is used for fine adjustment of the water pressure, and the discharge pressure of the hydraulic pump truck may be preciously adjusted by regulating the motor-driven pressure regulating valve 13.

Secondly, the liquid nitrogen pump equipment 2 is started. The gaseous nitrogen discharged from the liquid nitrogen pump equipment is mixed with the liquid water discharged from the hydraulic pump truck 7 and inputted to the mixture output manifold 11 through the manifold system 10. Because the pressure loading has been carried out for the water liquid discharged from the hydraulic damping apparatus unit 200 in advance, the liquid inputted to the manifold system 10 by the hydraulic pump truck is high pressure water liquid. When flowing to the manifold system 10, the gas discharged from the liquid nitrogen pump equipment has to overcome the pressure already existing therein, that is to say, the pressure of the water discharged from the hydraulic damping apparatus unit 200 is equal to the damping that the liquid nitrogen pump equipment 2 needs to overcome for discharging gas. Thus, the pressure loading of the nitrogen gas discharged from the liquid nitrogen pump equipment 2 is realized by using the output liquid pressure loading system of the hydraulic fracturing apparatus. During practical test and experiment, the flow rates of the liquid-gas mixtures discharged from the hydraulic pump truck 7 and the liquid nitrogen equipment 2 are adjusted by using the pneumatic cut-off valve 12 and the motor-driven pressure regulating valve 13, so as to adjust the pressure of nitrogen gas discharged from the liquid nitrogen pump equipment 2 in real time and thus to verify the accordance of the practical discharge pressure of the liquid nitrogen pump equipment 2 with design indices.

Thereafter, the liquid-gas mixtures discharged from the hydraulic pump truck 7 and liquid nitrogen pump equipment 2 are gathered to the gathering apparatus 15 and then entering into the liquid-gas separator 16. After the separation of the liquid-gas separator 16, the liquid continues to be involved in the recycle, whereas the gas is discharged into suitable atmosphere. For the security of the test and experiment, the quantity of the hydraulic pump trucks 7 required to be provided in the test and experiment is determined according to the gas displacement of the liquid nitrogen pump equipment and the highest gas content permitted in the liquid-gas mixture. In one embodiment of the invention, for example, to be accomplished is the test of a liquid nitrogen pump equipment having a normal gas displacement of 330 $sm^3$/min and a normal discharge pressure of 105 MPa, in order to ensure security during the test and experiment, it is required to control the mixed foam quality within 20%, and the hydraulic fracturing pump truck is required to have a liquid normal displacement equal to or greater than 1.9 $m^3$/min and a discharge pressure equal to or greater than 105 MPa. Accordingly, it is required to provide one hydraulic fracturing pump truck of 1500 type (i.e. the normal discharge power is 1500 kW) having a normal discharge pressure of 105 MPa. Also, two fracturing trucks having a discharge pressure of 105 MPa and normal displacement in range of 1.0 to 1.9 $m^3$/min may be used, such as YLC850-105 (the normal discharge power is 850 kW) or YLC1000-105 (the normal discharge power is 1000 kW), so as to accomplish the test.

Figure 2:
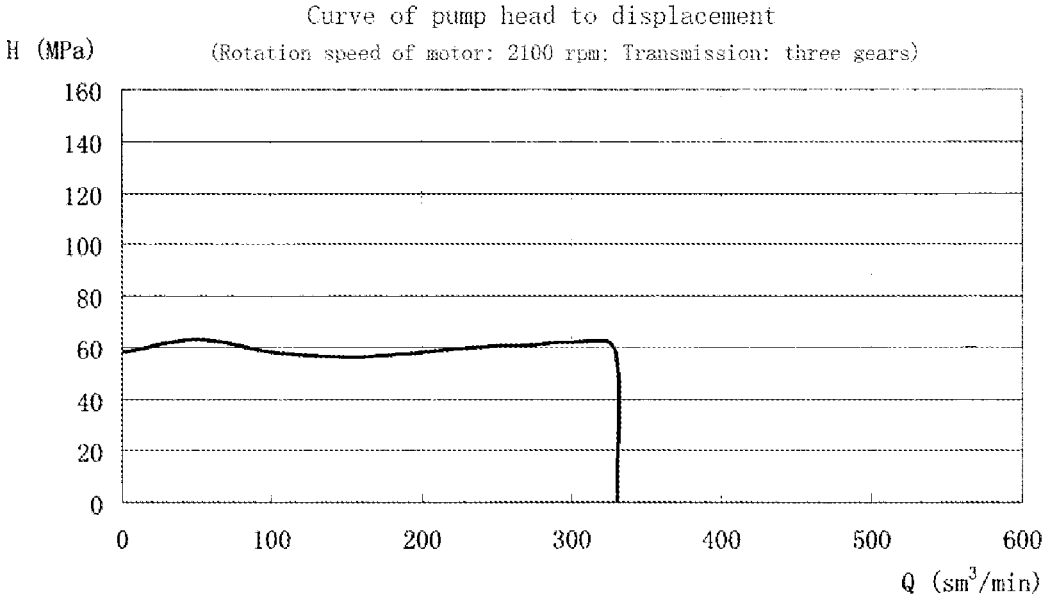
FIG. 2 is the curve of flow rate as a function of pressure in accordance with the invention.
Figure 3:
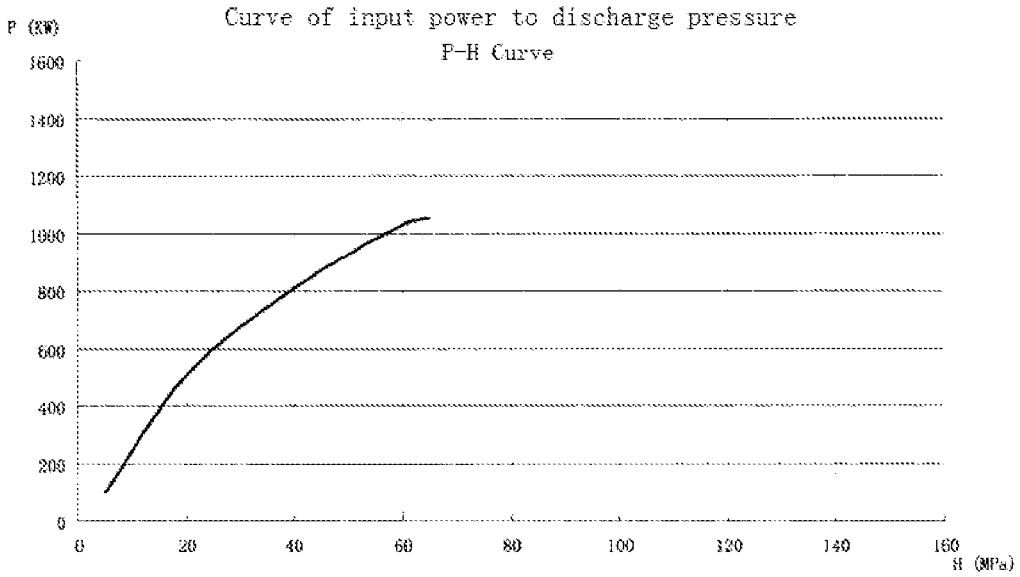
FIG. 3 is the curve of input power as a function of discharge pressure in accordance with the invention.
Figure 4:
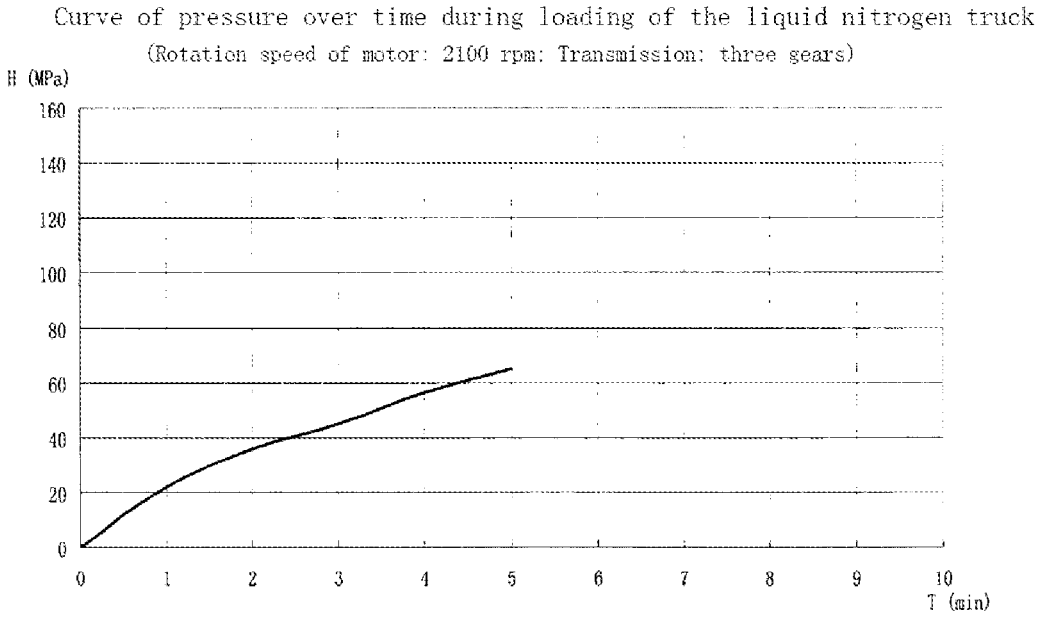
FIG. 4 is the curve of loading pressure as a function of loading time on a liquid nitrogen pump equipment in accordance with the invention.

The overall test and experiment apparatus for liquid nitrogen pump equipments is equipped with data collecting and processing system, which may be linked to the flow rate monitoring system on the liquid nitrogen equipment and will not be described in detail since it is not key point of the present invention. The output parameters of the displacement of the liquid nitrogen pump equipment and the power of the power system may both be collected in the data collecting system of the liquid nitrogen pump equipment per se. The power output parameter of the power system of the hydraulic pump truck may also be collected in the data collecting system of the hydraulic pump truck per se. Adjusting to the experiment condition and also the measuring, storing, collecting and outputting of the parameters needed to check out are achieved by the data collecting and processing system provided by the test and experiment system. The flow rate and pressure are measured under every gear of rotation speeds, and the flow rate-pressure curve (see FIG. 2), the input power-discharge pressure curve (see FIG. 3) and the loading pressure-loading time curve for the liquid nitrogen pump equipment (see FIG. 4) are drawn. The test and experiment system has the functions of automatic control and protection, adjustment of the outlet pressure (pump head), display of test condition, abnormal alarm and error protection etc.

The present test and experiment apparatus may also be used for the discharge flow rate test of high pressure gas equipments, such as liquid carbon dioxide pump trucks, and also the pressure loading, testing and experimenting of the discharged gas thereof.

INDUSTRIAL APPLICABILITY

The test and experiment process described above has the following characteristics: (1) The loading of the discharge pressure of the hydraulic fracturing equipment is carried out by using the hydraulic loading apparatus. Specialized manifold is used to mix nitrogen gas discharged from the liquid nitrogen pump equipment with liquid discharged from the hydraulic fracturing equipment. On one side, the experiment and test risk caused by the characteristic of high compression ratio of the gas is reduced by decreasing the gas to liquid ratio of the mixed gas-liquid flow discharged from the entire test system. On the other side, the pressure loading of the nitrogen gas discharged from the liquid nitrogen pump apparatus is carried out by using the discharged liquid pressure loading system of the hydraulic fracturing equipment. By means of transforming from liquid pressure to gas pressure, both the technical difficulty and the security risk caused by applying pressure loading to gas are avoided, and thus security is ensured in tests in accordance with the present invention. (2) The discharge flow rate and pressure of the hydraulic fracturing equipment are adjusted by using the pressure adjusting system, which is composed by the pneumatic cut-off valve component and the motor-driven pressure regulating valve as main parts, wherein the motor-driven pressure regulating valve is used for fine adjustment of the discharge pressure and its operation is easy but accurate. (3) During the overall test and experiment of the liquid nitrogen pump equipment for nitrogen foam fracturing, tests at every discharge pressure and every displacement can be accomplished of the liquid nitrogen pump equipment, so as to obtain the relationships between the displacement and the pressure, between the input power and the discharge pressure and between the loading pressure and the loading time, and then output results of the test and experiment. It is clearly seen from FIGS. 2 to 4 that the object of the test and experiment has been achieved by the loading test and experiment apparatus for liquid nitrogen pump equipment in accordance with the invention.

The present invention has the following advantages comparing to the prior art.

(1) The loading of the discharge pressure of the hydraulic fracturing equipment is carried out by using the hydraulic loading apparatus. Specialized manifold is used to mix nitrogen gas discharged from the liquid nitrogen pump equipment with liquid discharged from the hydraulic fracturing equipment. On one side, the experiment and test risk caused by the characteristic of high compression ratio of the gas is reduced by decreasing the gas to liquid ratio of the mixed gas-liquid flow discharged from the entire test system. On the other side, the pressure loading of the nitrogen gas discharged from the liquid nitrogen pump apparatus is carried out by using the discharged liquid pressure loading system of the hydraulic fracturing equipment. By means of transforming from liquid pressure to gas pressure, both the technical difficulty and the security risk caused by applying pressure loading to gas are avoided, and thus security is ensured in tests in accordance with the present invention.

(2) The discharge flow rate and pressure of the hydraulic fracturing equipment are adjusted by using the pressure adjusting system, which is composed by the pneumatic cut-off valve component and the motor-driven pressure regulating valve as main parts, wherein the motor-driven pressure regulating valve is used for fine adjustment of the discharge pressure and its operation is easy but accurate.

(3) The nitrogen gas displacement of the liquid nitrogen equipment is controlled by the power transmitting system and the flow distributing system of the equipment per se. No additional power is needed, and thus the equipment cost as well as energy can be saved.

What is claimed is:

1. An apparatus for loading test and experiment of liquid nitrogen pump equipments, comprising:

a liquid nitrogen tank comprising an outlet pipeline and a tested liquid nitrogen pump equipment, wherein said liquid nitrogen pump equipment is arranged on the outlet pipeline of the liquid nitrogen tank and pumps liquid nitrogen at the low pressure and low temperature stored in the liquid nitrogen tank and converts it into gaseous nitrogen at normal temperature and high pressure, a hydraulic damping apparatus unit comprising a water tank comprising an outlet pipeline, pump set equipment, and a manifold system which are connected in sequence, wherein said manifold system mixes the gaseous nitrogen at normal temperature and high pressure from the liquid nitrogen pump equipment with high pressure water from the pump set equipment to form a high pressure liquid-gas mixture; and a pressure adjusting unit arranged downstream from the hydraulic damping apparatus unit, which pressurizes the water discharged from the hydraulic damping apparatus unit by adjusting the flow rate of the high pressure liquid-gas mixture.

2. The apparatus for loading test and experiment of liquid nitrogen pump equipments according to claim 1, wherein, said pressure adjusting unit comprises at least one adjusting units, which are connected with each other, and subsequent water recycling equipments, wherein each of said adjusting units further comprises the following parts which are connected in sequence, a liquid-gas mixture output manifold assembled downstream from said manifold system, which distributes the mixed high pressure liquid-gas mixture as output;

at least one pneumatic cut-off valve, which roughly adjusts discharge pressure of said hydraulic pump truck;

at least one motor-driven pressure regulating valve, which finely adjusts the discharge pressure of said hydraulic pump truck; and a throttling hush pipe comprising an outlet, which applies pressure loading to the high pressure water discharged from said pump set equipment and limits noise by a silencer.

3. The apparatus for loading test and experiment of liquid nitrogen pump equipments according to claim 1, wherein, said manifold system comprises a high pressure water valve, a high pressure gas valve, a check valve and also pipelines.

4. The apparatus for loading test and experiment of liquid nitrogen pump equipments according to claim 1, wherein, the outlet pipelines of said water tank and said liquid nitrogen tank are equipped with check valves and also pressure sensors, respectively.

5. The apparatus for loading test and experiment of liquid nitrogen pump equipments according to claim 2, wherein, said subsequent water recycling equipments are connected to the outlet of said throttling hush pipe and comprises in sequence a gathering apparatus, a liquid-gas separator, connecting pipelines, a cooling system and also a recycling manifold, wherein said recycling manifold is connected to said water tank of said hydraulic damping apparatus unit;

wherein said gathering apparatus collects water and nitrogen gas and transports them into said liquid-gas separator which separates water from nitrogen gas, and the separated nitrogen gas is discharged under security condition, whereas the separated water continues to flow into said water tank through said connecting pipelines, said cooling system and said recycling manifold so as to be recycled.

6. The apparatus for loading test and experiment of liquid nitrogen pump equipments according to claim 1, wherein, said pump set equipment is assembled on the outlet pipeline of said water tank, and said pump set equipment is a hydraulic pump truck or combination of a water pump and a power system.

7. A loading test and experiment process for liquid nitrogen pump equipments, wherein the loading test and experiment of the liquid nitrogen pump equipments, which are used for foam fracturing of oil-gas field or coal bed methane nitrogen, are carried out with the loading test and experiment apparatus according to claim 1, comprising:

mixing with said hydraulic damping apparatus, firstly, gas discharged from said liquid nitrogen pump with high pressure water discharged from said hydraulic damping apparatus so as to form a high pressure liquid-gas mixture, and adjusting the flow rate of said high pressure liquid-gas mixture so that the pressure adjustment of the gas discharged from said liquid nitrogen pump equipment is indirectly achieved.

8. The loading test and experiment process for liquid nitrogen pump equipments according to claim 7, wherein, said process further comprises the following steps:

adjusting the discharge pressure of the hydraulic pump truck by starting said hydraulic pump truck and pressurizing the water discharged from said hydraulic pump truck, and simultaneously opening said pneumatic cut-off valve in said pressure adjusting unit for rough adjustment of the water pressure, while opening said motor-driven pressure regulating valve is for fine adjustment of the water pressure, so that accurate adjustment of the discharge pressure of the hydraulic pump truck is achieved; and starting said liquid nitrogen pump equipment and mixing the gaseous nitrogen discharged from said liquid nitrogen pump equipment with the high pressure water discharged from said hydraulic pump truck in said manifold system so as to form a high pressure liquid-gas mixture, and adjusting the flow rate of said high pressure liquid-gas mixture with said pneumatic cut-off valve and said motor-driven pressure regulating valve, so that the pressure of the nitrogen gas discharged from said liquid nitrogen pump equipment is controlled.

* * * * *